US007484676B2

(12) United States Patent
Joseph et al.

(10) Patent No.: US 7,484,676 B2
(45) Date of Patent: Feb. 3, 2009

(54) EASY CLEAN SPRAY GUN

(75) Inventors: Stephen C. P. Joseph, Woodbury, MN (US); Russell E. Blette, Hastings, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 168 days.

(21) Appl. No.: 10/529,840

(22) PCT Filed: Oct. 13, 2003

(86) PCT No.: PCT/US03/32671

§ 371 (c)(1),
(2), (4) Date: Mar. 31, 2005

(87) PCT Pub. No.: WO2004/037432

PCT Pub. Date: May 6, 2004

(65) Prior Publication Data

US 2006/0065761 A1 Mar. 30, 2006

(30) Foreign Application Priority Data

Oct. 24, 2002 (GB) ..... 0224697.3

(51) Int. Cl.
*B05B 1/28* (2006.01)

(52) U.S. Cl. ..... 239/290; 239/600; 239/291; 239/292; 239/526; 239/345

(58) Field of Classification Search ..... 239/290–301, 239/600, 526, 527, 345
See application file for complete search history.

(56) References Cited

U.S. PATENT DOCUMENTS 1,751,787 A 3/1930 Binks
1,990,823 A 2/1935 Gustafson
2,497,625 A 2/1950 Norwick
3,236,459 A * 2/1966 McRitchie ..... 239/416
3,746,253 A 7/1973 Walberg
4,171,096 A 10/1979 Welsh et al.
4,483,483 A * 11/1984 Grime ..... 239/526
4,811,904 A 3/1989 Ihmels et al.
4,817,872 A * 4/1989 Mattson ..... 239/300
4,917,300 A 4/1990 Gloviak et al.
4,959,159 A * 9/1990 Mattson ..... 239/526
4,971,251 A 11/1990 Dobrick et al.

(Continued)

FOREIGN PATENT DOCUMENTS

DE 401944 C 9/1924

(Continued)

*Primary Examiner*—Dinh Q Nguyen
(74) *Attorney, Agent, or Firm*—Pamela L. Stewart

(57) ABSTRACT

A spray gun 101 has a spray head 150 connected to a body 102 of the spray gun 101 and a reservoir 156 connected to the spray head 150 for supplying liquid to a spray nozzle 153 of the spray head 150. The spray head 150 is arranged so that liquid from the reservoir 156 is delivered to the spray nozzle 153 without passing through the spray gun body 102 in response to actuation of the spray gun 101 via a trigger 105. The spray head 150 is releasably secured and can be detached from the spray gun body 102 and thrown away after use. The reservoir 156 is mounted on the spray head 150 and can be removed and thrown away with the spray head 150 after use.

18 Claims, 12 Drawing Sheets

U.S. PATENT DOCUMENTS

| | | | | | |
|---|---|---|---|---|---|
| 5,090,623 | A | | 2/1992 | Burns et al. | |
| 5,102,051 | A | | 4/1992 | Smith et al. | |
| 5,110,011 | A | | 5/1992 | Laska et al. | |
| 5,209,405 | A | | 5/1993 | Robinson et al. | |
| 5,259,558 | A | | 11/1993 | Smith et al. | |
| 5,322,221 | A | | 6/1994 | Anderson | |
| 5,344,078 | A | | 9/1994 | Fritz et al. | |
| 5,366,158 | A | * | 11/1994 | Robisch et al. | 239/289 |
| 5,501,397 | A | * | 3/1996 | Holt | 239/124 |
| 5,639,027 | A | | 6/1997 | Fritz | |
| 5,803,367 | A | | 9/1998 | Heard et al. | |
| 5,826,795 | A | | 10/1998 | Holland et al. | |
| 6,019,294 | A | | 2/2000 | Anderson et al. | |
| 6,098,902 | A | * | 8/2000 | Culbertson et al. | 239/290 |
| 6,588,681 | B2 | | 7/2003 | Rothrum et al. | |
| 6,752,179 | B1 | | 6/2004 | Schwartz | |
| 6,874,702 | B2 | * | 4/2005 | Turnbull | 239/526 |
| 7,246,759 | B2 | | 7/2007 | Turnbull | |
| 2002/0080207 | A1 | | 6/2002 | Kanda et al. | |
| 2002/0148910 | A1 | | 10/2002 | Reetz, III et al. | |
| 2003/0052190 | A1 | | 3/2003 | Ulrich et al. | |
| 2004/0084553 | A1 | | 5/2004 | Joseph et al. | |

FOREIGN PATENT DOCUMENTS

| | | | |
|---|---|---|---|
| DE | 485540 | C | 11/1929 |
| DE | 43 02 911 | A1 | 8/1993 |
| DE | 4302911 | A | 8/1993 |
| EP | 0371634 | A2 | 6/1990 |
| EP | 0492333 | A1 | 7/1992 |
| SU | 172206 | A | 7/1965 |

* cited by examiner

EASY CLEAN SPRAY GUN

FIELD OF THE INVENTION

This invention concerns improvements in or relating to liquid spraying apparatus such as a spray gun. More especially, the invention relates to the delivery system for the liquid to be sprayed. The invention has particular application to a spray head for reducing the amount of cleaning of the spray gun required on completion of spraying and/or when changing over the spray gun to spray a different liquid.

BACKGROUND OF THE INVENTION

Spray guns are widely used in vehicle body repair shops when re-spraying a vehicle that has been repaired following an accident. In the known spray guns, the liquid is contained in a reservoir attached to the gun from where it is fed to a spray nozzle. On emerging from the spray nozzle, the liquid is atomised and forms a spray with compressed air supplied to the nozzle. The liquid may be gravity fed or suction fed or, more recently, pressure fed by an air bleed line to the reservoir from the compressed air line to the spray gun.

Traditionally, the liquid is contained in a rigid pot detachably mounted on the spray gun and is delivered to the spray nozzle under the control of a manually operable trigger mechanism on the gun. On completion of spraying, the pot is removed and the gun and pot cleaned for re-use.

With this arrangement, the gun and pot must be thoroughly cleaned with solvents to remove all traces of the liquid to prevent cross-contamination with the next liquid to be sprayed. Particular problems arise when cleaning the gun to ensure no deposits are formed within the gun that may affect the operation of the gun. As a result, the spray nozzle may have to be dis-assembled to enable the spray nozzle and internal passageways of the gun to be properly cleaned. This is time consuming and the use of solvents is undesirable from health and safety considerations and causes problems for disposal of the solvent after use.

We have recently developed a system in which the reservoir is disposable after use thereby reducing the amount of cleaning required on completion of spraying. With this system, however, the spray gun including the spray nozzle must still be cleaned to remove all traces of the liquid before the gun is put away or before spraying another liquid.

DE-A-4302911 discloses a paint spray gun having a replaceable single-use spray nozzle releasably secured to the spray gun body allowing the spray nozzle to be removed after use and replaced by a new spray nozzle. The spray nozzle has an integral (built-in) needle valve shaft which acts as an open close valve and a branch tube for supply of liquid to be sprayed. The rear end of the spray nozzle is inserted into the spray gun body and is secured by tightening a transverse bolt to engage the rear end of the spray nozzle. The needle valve shaft is connected to a trigger mechanism within the spray gun body by tightening a clamping sleeve to engage the free end of the shaft. A pair of opposed inwardly directed air streams are provided by a cap nut screwed onto the spray gun body separate from the spray nozzle.

SUMMARY OF THE INVENTION

The present invention has been made from a consideration of the foregoing problems and disadvantages of the existing delivery systems for spraying a liquid.

More especially, embodiments of the present invention provide an improved liquid delivery system for use with a spray gun whereby cleaning of the spray gun on completion of spraying and/or when changing over the spray gun to spray a different liquid may be simplified.

In particular, at least one embodiment of the present invention provides a liquid delivery system including a spray head in which the liquid is delivered to a spray nozzle from a reservoir connected to the spray head without passing through the spray gun body.

Furthermore, at least one embodiment of the present invention provides a liquid delivery system in which the spray head is detachable from the spray gun and can be thrown away after use such that the amount of solvent used to clean the spray gun may be reduced.

In addition, at least one embodiment of the present invention provides a liquid delivery system in which a reservoir for the liquid to be dispensed is mounted on the spray head and is detachable with the spray head from the spray gun.

Thus, according to one aspect of the present invention, there is provided liquid spraying apparatus as defined in claim 1.

As used herein, the term "liquid" refers to all forms of flowable materials that can be applied to a surface using a spray gun (whether or not they are intended to colour the surface) including (without limitation) paints, primers, base coats, lacquers, varnishes and similar paint-like materials as well as other materials such as adhesives, sealers, fillers, putties, powder coatings, blasting powders, abrasive slurries, mould release agents and foundry dressings which may be applied in atomised or non-atomised form depending on the properties and/or the intended application of the material and the term "liquid" is to be construed accordingly.

By connecting the reservoir to the spray head and arranging for the spray head to be detachable from the spray gun, cleaning of the spray gun is simplified. As a result, a reduction in the amount of solvent used to clean the spray gun may be possible.

More particularly, liquid withdrawn from the reservoir in use is delivered to the spray nozzle through the spray head body without passing through the spray gun body. In this way, the extent to which the spray gun body is contaminated by the liquid and the amount of cleaning required on completion of spraying or when changing over the spray gun to spray another liquid may be reduced.

Preferably, the spray head is disposable and can be thrown away after use. In this way, cleaning of the spray head can be avoided and the spray gun can be changed over to dispense another liquid by attaching a new spray head with a clean spray nozzle connected to a reservoir for the liquid.

The mateable formations for releasably securing the spray head to the spray gun may form a bayonet type connection that facilitates rapid connection/disconnection of the spray head with a simple push twist action. Any other suitable type of mateable formations providing a releasable connection may be employed.

The reservoir may be provided at a remote location and connected to the spray head by a flexible delivery line. Preferably, the delivery line includes a manually operable valve to close the delivery line when disconnected from the spray head.

Alternatively, the reservoir may be mounted on the spray head. For example, the spray head body may be provided with an inlet connected to the reservoir. In one arrangement, the connection between the reservoir and the spray head is releasable such that the reservoir can be detached from the spray head, for example, a bayonet type connection. In this way, the reservoir may be re-usable. More preferably the reservoir or at least the parts of the reservoir contaminated by contact with the liquid are disposable and can be discarded after use. In this way, contaminated parts may be thrown away and the spray gun re-used with a new spray head and reservoir. As a result, the amount of cleaning required on completion of spraying or when changing over the liquid to be sprayed is reduced.

The reservoir may be collapsible as liquid is withdrawn in use and may be supplied empty for the end user to fill or pre-filled with liquid for connection to the spray head. Where the reservoir is pre-filled, an outlet for the liquid is provided with a closure to seal the reservoir until it is desired to fit the reservoir to the spray head.

Preferably, the spray nozzle is adapted to atomise the liquid to form a spray. For example, the spray nozzle may be arranged to mix the liquid emerging from the nozzle with a supply of compressed air.

In a preferred arrangement, the spray nozzle has a central hole for the liquid surrounded by a concentric annular opening for compressed air and a pair of opposed inwardly directed apertures for compressed air arranged on opposite sides and spaced forwardly of the central hole. In this way, the liquid emerging from the central hole is mixed with air streams emerging from the concentric annular opening and from the inwardly directed apertures to cause the liquid to atomise and form a fine spray for application to a substrate.

The air streams from the inwardly directed apertures may be adjustable to adapt the spray nozzle for dispensing different liquids. For example, the inwardly directed apertures may be provided by a member mounted on the spray head body, and a set of interchangeable members may be provided for releasable connection to the spray head body to change, for example, the atomisation parameters or spray pattern as desired.

Preferably, the needle of the trigger mechanism controls dispensing of the liquid and the air supply to the spray nozzle for atomising the liquid. For example, the needle may be moved from an advanced position closing the bore to a retracted position opening the bore when the trigger mechanism is actuated. With this arrangement the needle may have to be wiped clean when the spray head is removed but this is a simple operation and may be effected without the use of solvents.

According to another aspect of the present invention, there is provided a spray head for attachment to a spray gun body as defined in claim 19.

The spray head may be employed with spray guns of the gravity feed, pressure feed or suction feed type. Existing spray guns having an inlet for connection to a liquid reservoir may be converted for use with the spray head by closing the inlet, for example with a blanking plug. If required, an adaptor may be provided to connect the spray head body to the spray gun body.

A reservoir for the liquid to be dispensed may be mounted on the spray head so as to be removable from the spray gun with the spray head. The reservoir may be releasably connected to the spray head and may be disposable or re-usable. Alternatively, the spray head and reservoir may be permanently joined together.

The spray head may be adapted for atomising the dispensed liquid. For example, the spray nozzle may be arranged to provide opposed inwardly directed air streams to mix with concentric streams of liquid and air emerging from the spray nozzle to atomise the liquid and create a spray. The atomisation parameters or spray pattern may be controlled by adjusting the inwardly directed air streams.

The spray head and reservoir could be "all-in-one".

Other features, benefits and advantages of the invention will be apparent from the following detailed description of exemplary embodiments of the invention with reference to the accompanying drawings.

DETAILED DESCRIPTION OF THE EXEMPLARY EMBODIMENTS

Figure 1:
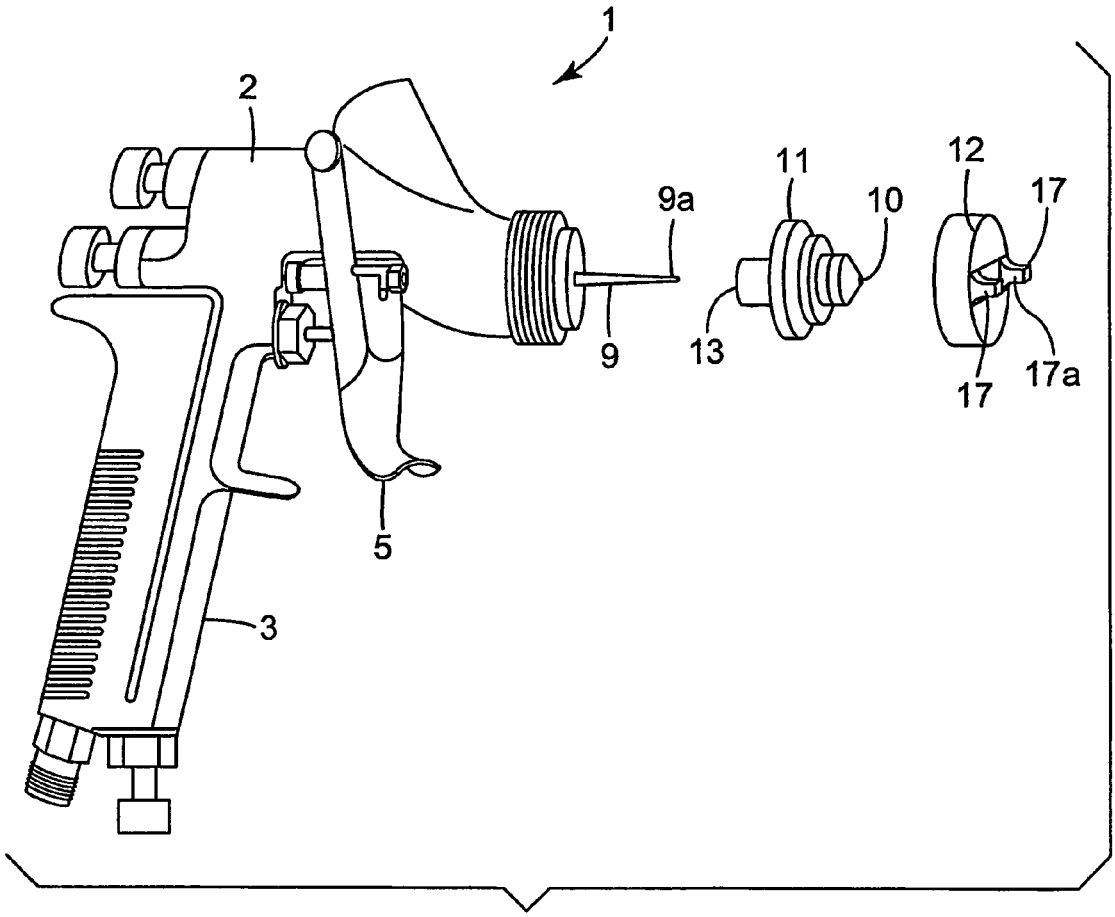
FIG. 1 is a side view of a prior art gravity feed spray gun showing the component parts of the spray nozzle detached from the body of the spray gun.
Figure 2:
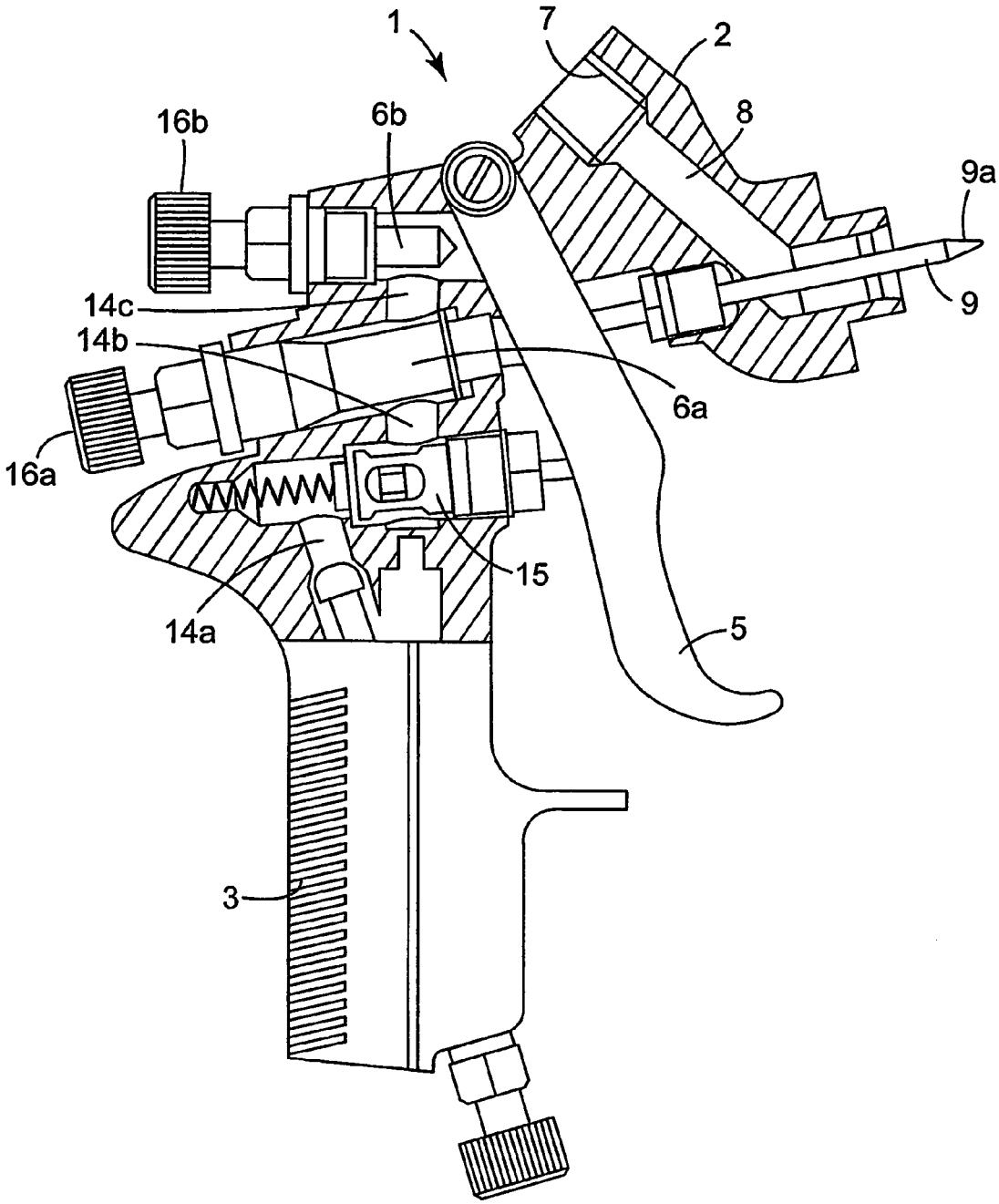
FIG. 2 is a side view, partly sectioned, of the body of the spray gun shown in FIG. 1.
Figure 3:
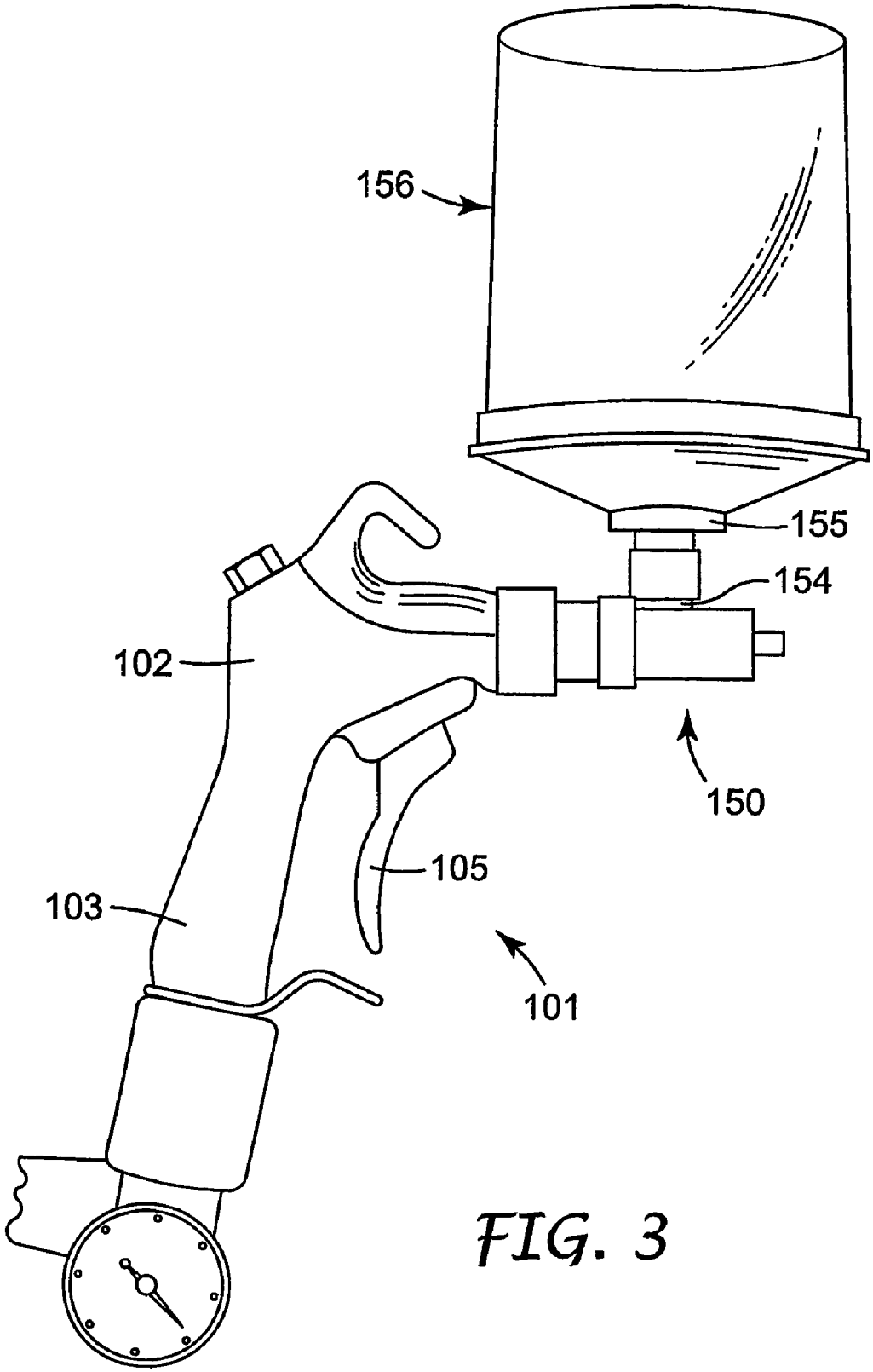
FIG. 3 is a side view of a gravity feed spray gun embodying the present invention.

Referring first to FIGS. 1 and 2 of the accompanying drawings, there is shown a typical prior art paint spray gun 1 of the gravity feed type.

The gun 1 comprises a body 2, a handle 3 that extends downwardly from the rear end of the body 2 and a spray nozzle 4 at the front end of the body 2. The spray gun 1 is manually operable by a trigger 5 that is pivotally mounted on the sides of the gun 1.

A paint reservoir (not shown) is detachably secured to the gun 1 via an internally threaded inlet 7 on the top of the gun 1. The reservoir may have an externally threaded outlet for screwing directly into the inlet 7 or into an adaptor (not shown) screwed into the inlet 7. The reservoir may be of any known construction and provides a supply of paint to the spray nozzle 4 via an internal passageway 8 formed in the body 2 of the gun 1.

The spray nozzle 4 comprises an inner component 11 and an outer component 12 that screws onto the front end of the body 2 of the gun 1 and retains the inner component 11.

The inner component 11 has a through bore 13 terminating at the front end in a hole 10. The rear end of the bore 13 communicates with the passageway 8.

The trigger 5 is connected to the rear end of a needle 9 that extends through the passageway 8 and is received in the bore 13 in an inoperative position of the trigger 5 to close the hole 10 and prevent escape of paint from the passageway 8.

The front end of the inner component 11 is received in a central aperture (not shown) in the outer component 12 and defines an annular opening concentric with the hole 10. The outer component 12 is provided with a pair of horns 17 that project forwardly from the spray nozzle 4 on opposite sides of the hole 10. The horns 17 are provided with opposed inwardly directed apertures 17*a*.

In use, the spray gun 1 is connected to a source of compressed air (not shown) via a connector (not shown) at the lower end of the handle 3. The air is delivered to the spray nozzle 4 via internal passageways 14*a,b,c* in the handle 3 and body 2 of the gun 1 in response to actuation of the trigger 5.

The flow of air is controlled by an on/off valve 15 operable by the trigger 5 and by flow regulators 6*a*,6*b* adjustable to set the flow rate by means of rotatable control knobs 16*a,b*.

The trigger 5 is biased to the inoperative position in which the needle 9 closes spray nozzle 4 to prevent escape of paint from the hole 10 and the valve 15 is closed to cut-off the air supply to the spray nozzle 4.

When the user pulls the trigger 5, the needle 9 is retracted to a position in which a tapered front end 9*a* of the needle 9 is received in the rear end of the bore 13 to open the spray nozzle 4. As a result, liquid flows from the passageway 8 through the bore 13 and emerges from the hole 10. At the same time, the valve 15 is opened to deliver air to the spray nozzle 4 where it emerges from the opening concentric with the hole 10 and from the opposed apertures 17*a* of the horns 17 on opposite sides of the spray nozzle 4.

The horns 17 direct the air-flow inwardly where it mixes with and atomises the concentric paint/air streams emerging from the spray nozzle 4 to form a spray. The rate of discharge of the paint and the flow of air is controlled by the displacement of the trigger 5 from the inoperative position under the control of the user to produce the desired spray.

After use, the reservoir can be detached from the spray gun 1 for cleaning or disposal according to the type of reservoir employed. The spray gun 1 then has to be cleaned to remove all traces of paint from the internal passageway 8 connecting the spray nozzle 4 to the inlet 7 as well as from the needle 9 within the passageway 8 and the spray nozzle 4 itself.

This typically requires the spray nozzle 4 to be dis-assembled and re-assembled after cleaning to ensure no paint remains within the spray gun 1 that may cause cross-contamination when spraying another liquid or may form deposits within the gun 1 that could affect performance of the gun.

Such cleaning is time consuming and exposes the user to the solvents commonly used for cleaning. The use of solvents presents health and safety hazards for the user and creates problems for the disposal of the solvents after use. All of this adds considerably to operating costs.

Referring now to FIGS. 3 to 6 of the accompanying drawings, there is shown a gravity feed spray gun according to a first embodiment of the present invention in which like reference numerals in the series 100 are used for convenience to indicate parts corresponding to the spray gun shown in FIGS. 1 and 2.

In this embodiment, the gravity feed spray gun 101 has a body 102, a handle 103 extending downwardly from the body 102 and a trigger 105 pivotally mounted on the body 102 for controlling operation of the spray gun 101 as described later herein.

A removable spray head 150 is attached to the body 102 of the gun 101 by a bayonet type connection that allows the spray head 150 to be detached from the gun 101. In this embodiment, the spray head 150 is made of lightweight plastics material, for example by moulding, but it will be understood other materials may be employed.

The spray head 150 has a socket 151 (FIGS. 4 to 6) at the rear end and a spray nozzle 153 at the front end. A paint reservoir 156 is mounted on the spray head 150 to connect an outlet 155 to an inlet 154 between the front and rear ends for supplying paint to the spray nozzle 153 as described later herein.

The wall of the socket 151 is provided with a pair of opposed bayonet grooves 152 (one only shown) comprising an axial guide portion 152*a* terminating at the inner end in a circumferential retention portion 152*b*.

The front end of the body 102 of the gun 101 is provided with a pair of outwardly projecting lugs (not shown) that are engageable in the grooves 152 with a push-twist action to secure the spray head 150 to the spray gun 101. It will be understood that any other type of releasable connection may be provided between the spray head 150 and the gun 101.

Figure 6:
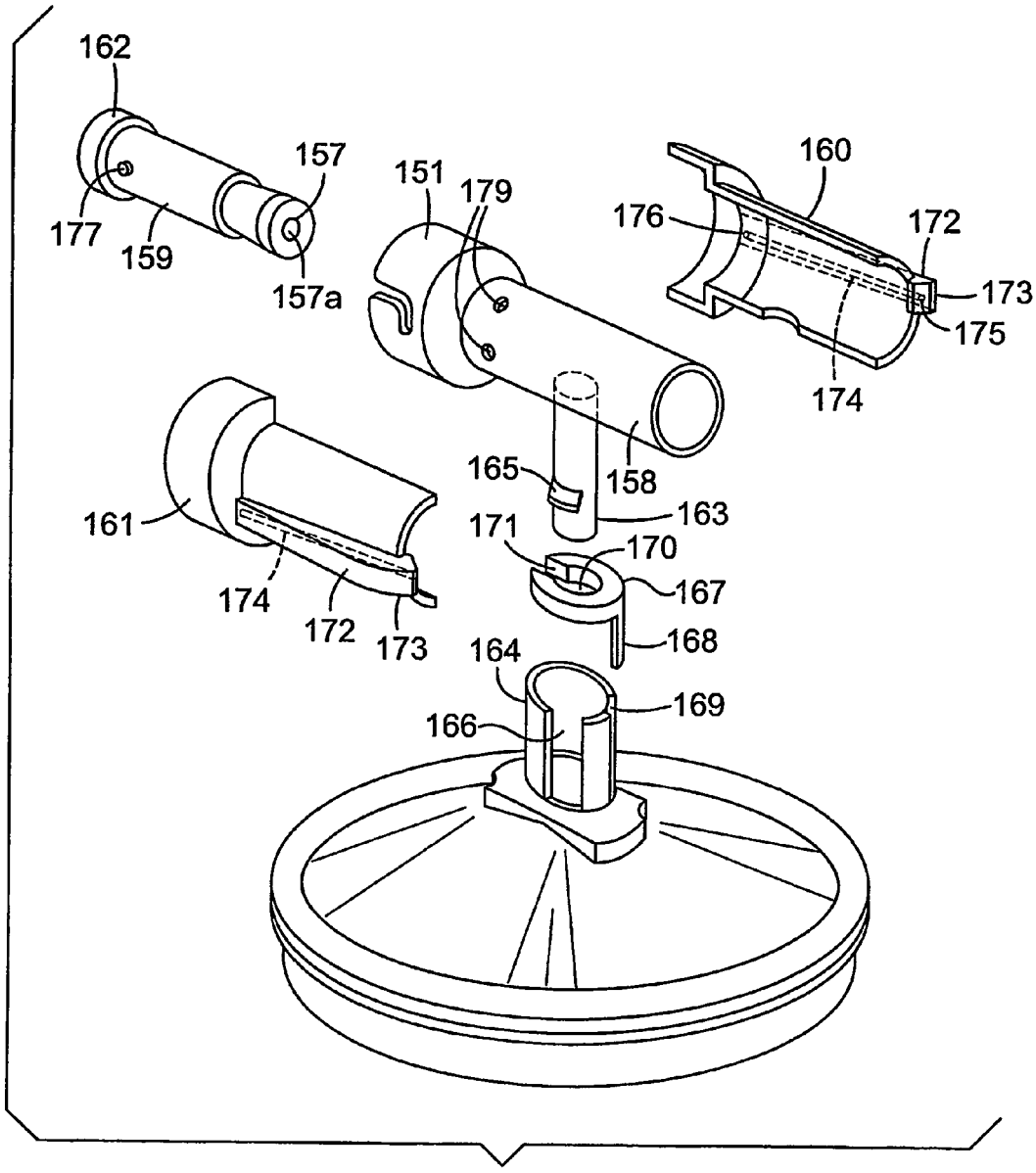
FIG. 6 is an exploded isometric view of the spray head and lid shown in FIG. 5.

As best shown in FIG. 6, the spray head 150 comprises a hollow tubular body 158, an insert 159, and a pair of air horn members 160,161.

The socket 151 is provided at the rear end of the body 158 and the insert 159 is a push-fit in the body 158 from the rear end. An annular flange 162 at the rear end of the insert 159 is engageable with the base of the socket 151 to locate axially the insert 159 in the body 158.

The insert 159 has an axial through bore 157 in which a tapered front end of a needle (not shown) controlling flow of paint from the reservoir 156 is received. The bore 157 communicates via a radial port (not shown) intermediate the ends of the insert 159 with a radial inlet tube 163 connected to the body 158.

The insert 159 and body 158 are provided with co-operating formations (not shown) to locate the insert 159 in the required angular orientation to align the radial port with the inlet tube 163.

The inlet tube 163 is connected to an outlet tube 164 from the paint reservoir 156 for supplying paint to the spray nozzle 150. The inlet tube 163 has a radial lug 165 adjacent to the distal end that is received in a first axial slot 166 in the wall of the outlet tube 164 to locate angularly the reservoir 156 relative to the spray head 150.

A retainer ring 167 seats on the outer end of the outlet tube 164 and has an axial leg 168 received in a second axial slot 169 in the wall of the outlet tube 164 angularly offset from the first slot 166.

The retainer ring 167 has a central hole 170 and a radial slot 171 that allows the inlet tube 163 to be passed through the ring 167 prior to locating the ring 167 on the outlet tube 164. The radial slot 171 is angularly offset relative to the first axial slot 166 when the leg 168 is received in the second axial slot 169.

As a result, the inlet tube 163 is rotated to a position in which the lug 165 is offset relative to the radial slot 171 to enable the leg 168 to be located in the second axial slot 169. In this way, the reservoir 156 is located and retained in the spray head 150 in the required angular orientation.

The trigger 105 is connected to the rear end of the needle (not shown) received in the through bore 157 of the insert. The needle is movable axially of the bore 157 between an advanced position in which it covers the radial port and a retracted position in which it is clear of the radial port in response to actuation of the trigger 105.

In this way, flow of paint from the reservoir 156 to the spray nozzle 153 is prevented in the advanced position of the needle and permitted in the retracted position. Furthermore, the needle seals the inner end of the bore 157 in both positions to prevent contamination of the spray gun body 102 by leakage of paint from the bore 157 into the socket 151.

The horn members 160, 161 are of similar semi-cylindrical shape that fit onto and surround the front end of the body 158 of the spray head 150. The members 160, 161 have external axial ribs 172 that provide horns 173 on opposite sides the spray nozzle 153.

The ribs 172 are formed with internal air passageways 174 that communicate at one end with opposed apertures 175 in the horns 173. At the other end, the passageways 174 are formed with inlet holes 176 (one only shown) that open into an air chamber formed between the members 160,161 and the body 158.

Figure 4:
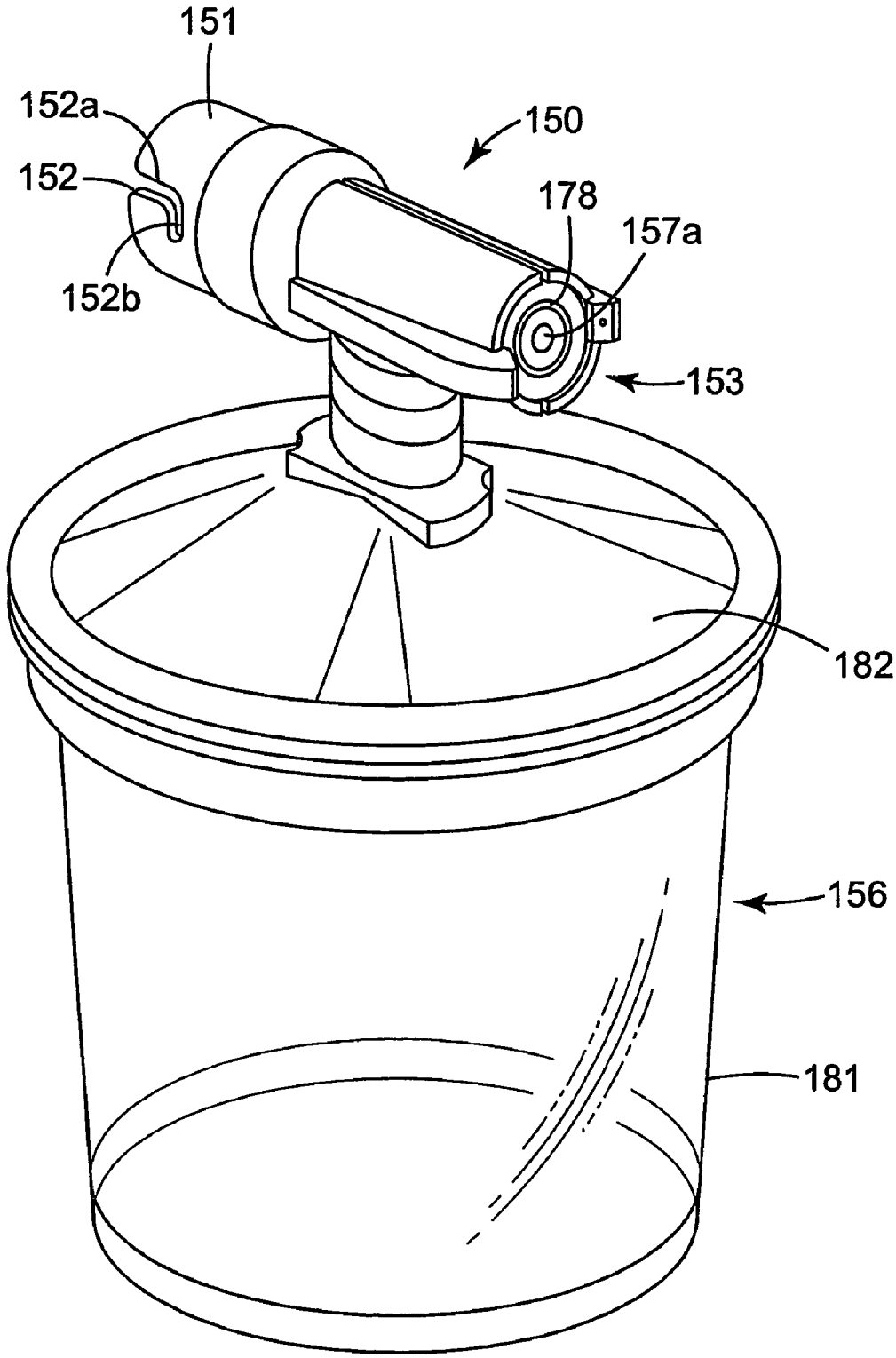
FIG. 4 is a perspective view of the spray head and reservoir shown in FIG. 3.
Figure 5:
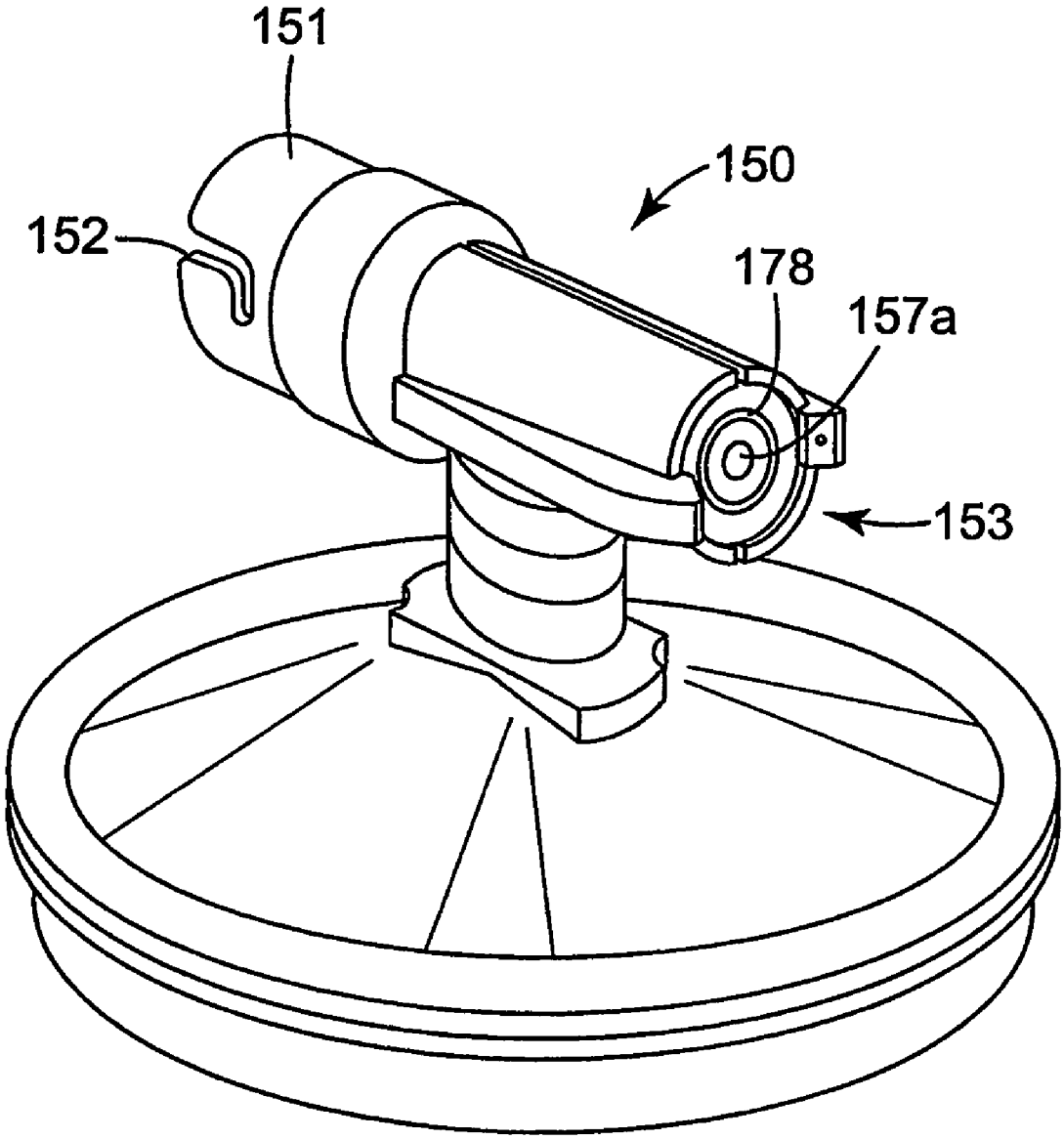
FIG. 5 is a perspective view of the spray head and lid of the reservoir shown in FIG. 4.

The rear end of the insert 159 is in communication with an air supply passageway (not shown) in the spray gun body 102. The insert 159 has radial ports 177 (one only shown) through which air can pass into the space between the insert 159 and the body 158 within the spray head 150 to emerge from an annular opening 178 (FIGS. 4 and 5). The opening 178 is concentric with a hole 157*a* at the front end of the bore 157 from which the liquid emerges.

The body 158 has radial ports 179 that open into the air chamber and allow air to pass along the passageways 174 in the ribs 172 and emerge from the apertures 175 in the horns 173.

In use, a compressed air line (not shown) is connected to the lower end of the handle 103 and the trigger 105 is operable to actuate an on/off valve (not shown) in the spray gun body 102 to control the air supply to the spray head 150.

When the user pulls the trigger 105, the needle is retracted to open the bore 157 in the insert 159 and allow paint supplied to the spray head 150 from the reservoir 156 to emerge from the hole 157*a* in the spray nozzle 153. At the same time, the trigger 105 actuates the on/off valve to deliver air to the spray head 150 via internal passageways (not shown) in the spray gun body 102. The air passes through the spray head 150 and emerges from opening 178 concentric with the hole 157*a* and from the apertures 175 in the horns 173. The horns 173 direct the air inwards where it mixes with the concentric paint/air streams emerging from the front end of the nozzle 153 and causes the paint to atomise and form a spray.

The horns 173 may be detachably secured to the front end of the spray head body 158 by any suitable means. For example, the members 160,161 may clip-on the spray head body 158. In this way, the spray head 150 can be adapted according to the desired atomisation parameters or spray pattern of the paint to be sprayed by selecting and fitting the appropriate pair of members 160,161 to vary the size and/or position of the horns 173 to control the flow and/or direction of the air emerging from the horns for mixing with the paint/air streams emerging from the nozzle 153.

As will be appreciated, the paint flows directly from the reservoir 156 to the spray nozzle 153 through the spray head 150 without passing through the spray gun body 102. As a result, on completion of spraying or when it is desired to change over the paint to be sprayed, the spray head 150 and reservoir 156 can be detached from the spray gun body 102, the needle wiped clean and a new spray head/reservoir combination attached to the spray gun body 102. In this way, the amount of cleaning required is reduced and the spray gun 101 can be quickly changed over to spray another liquid with a minimum disruption.

In this embodiment, the reservoir 156 comprises an open-topped container 181 closed by a lid 182. The container 181 is made of plastics and has flexible walls so as to be collapsible in use. The lid 182 is also made of plastics and is sufficiently rigid to maintain its shape in use. The lid is of frusto-conical shape and the outlet tube 164 is provided at the apex of the lid 182 for connection to the inlet tube 163 of the spray head 150. The marginal edge of the container 181 is permanently secured to the rim of the lid 182, for example by adhesive or by welding.

The reservoir 156 may be supplied pre-filled with paint or other liquid to be dispensed and a removable closure such as a screw cap (not shown) attached to the outlet tube 164. Alternatively, the lid 182 could be provided with a filler opening (not shown) separate from the outlet tube and a removable closure such as a screw cap (not shown). In this way, the reservoir 156 may be supplied empty and filled by the end user with paint or other liquid to be prayed. The filler opening may also permit re-filling of the reservoir 156 and be arranged so this can be carried out while the reservoir 156 is attached to the spray head 150 on the spray gun 101. A filter (not shown) could be incorporated in the underside of the lid 182 to screen out contaminant particles before the paint reaches the spray nozzle 153.

In use, the container 181 collapses inwardly as paint is withdrawn from the reservoir 156 and, on completion of spraying, the spray head 150 and reservoir 156 can be removed from the spray gun 101. Any paint remaining in the reservoir 156 can be stored for a short period of time and the spray head 150 re-attached to the spray gun 101 to use the paint. When the reservoir 156 is empty or any remaining paint is not required, the spray head 150 and reservoir 156 can be discarded as an assembly or separately. In this way, contaminated parts of the paint delivery system are disposable after use.

Figure 7:
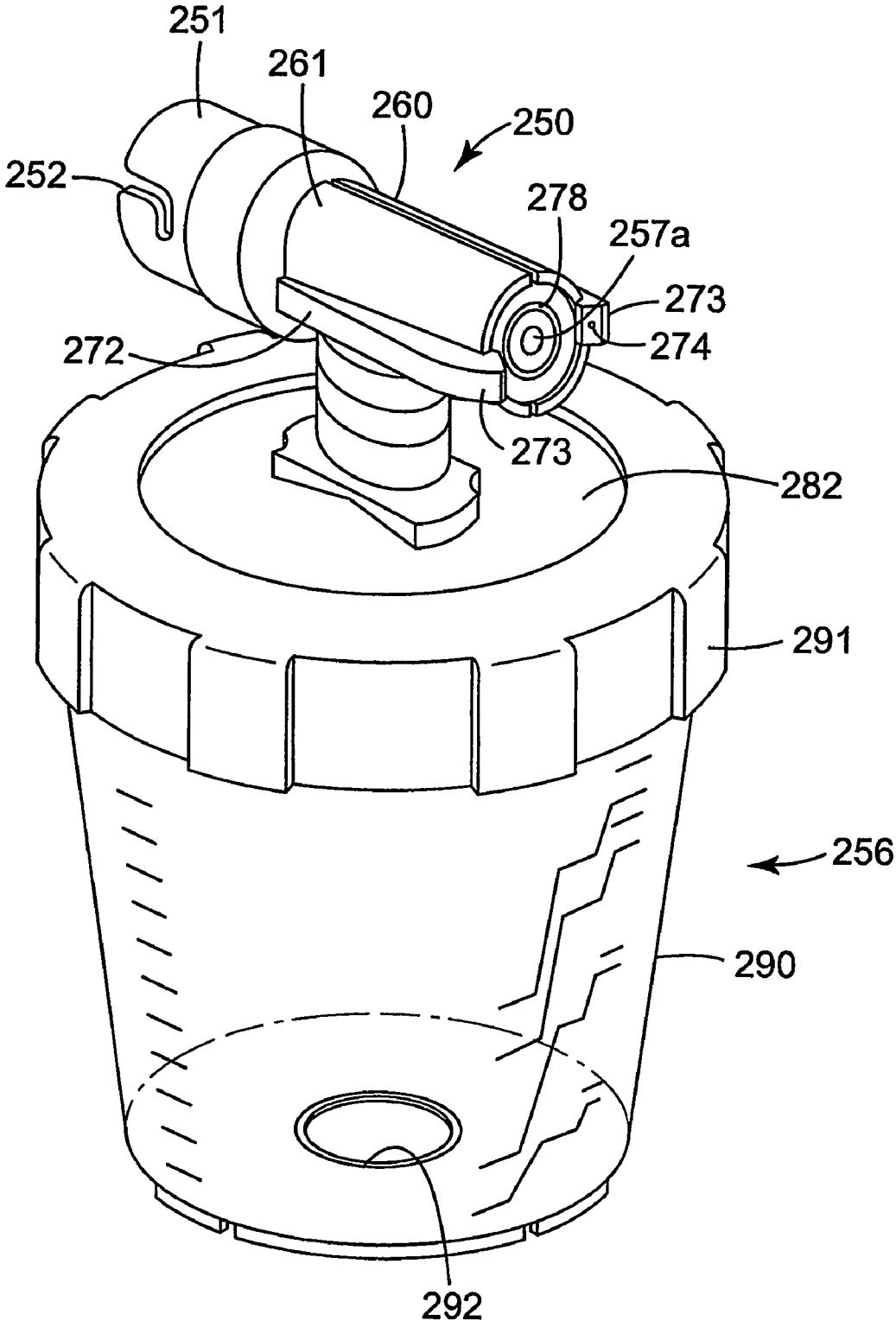
FIG. 7 is a perspective view showing an alternative reservoir attached to the spray head shown in FIGS. 4 to 6.

Referring now to FIG. 7 of the drawings, there is shown a modification to the reservoir for storing the paint or other liquid to be dispensed. For convenience, like reference numerals in the series 200 are used to indicate parts corresponding to the previous embodiment.

In FIG. 7, the lid 282 is separate from the collapsible container and the reservoir 256 includes an outer pot 290 in which the flexible container is received. The lid 282 is secured to the flexible container by a collar 291 that fits over the marginal edge of the lid 282 and screws onto the upper end of the outer pot 290 to clamp and seal the lid 282 relative to the container.

The flexible container provides a lining for the outer pot 290 and, after use, the lid 282 and flexible container can be discarded and the outer pot 290 and collar 291 re-used with a new clean lid and flexible container. In use, the flexible container collapses as paint is withdrawn from the reservoir 256 and the outer pot 290 is provided with an air hole 292 in the base to prevent a vacuum forming within the pot 290 to allow the container to collapse.

The outer pot 290 and flexible container may be transparent or translucent to allow the contents to be inspected visually and scale markings provided on the pot 290 to indicate the volume of the contents. With this arrangement, the flexible container can be supported in the outer pot and the paint or other liquid added to and mixed in the container prior to attaching the lid 282.

In other respects, the construction and operation of the spray head 250 and reservoir 256 is similar to the previous embodiment and will be understood from the description of FIGS. 3 to 6.

Figure 8:
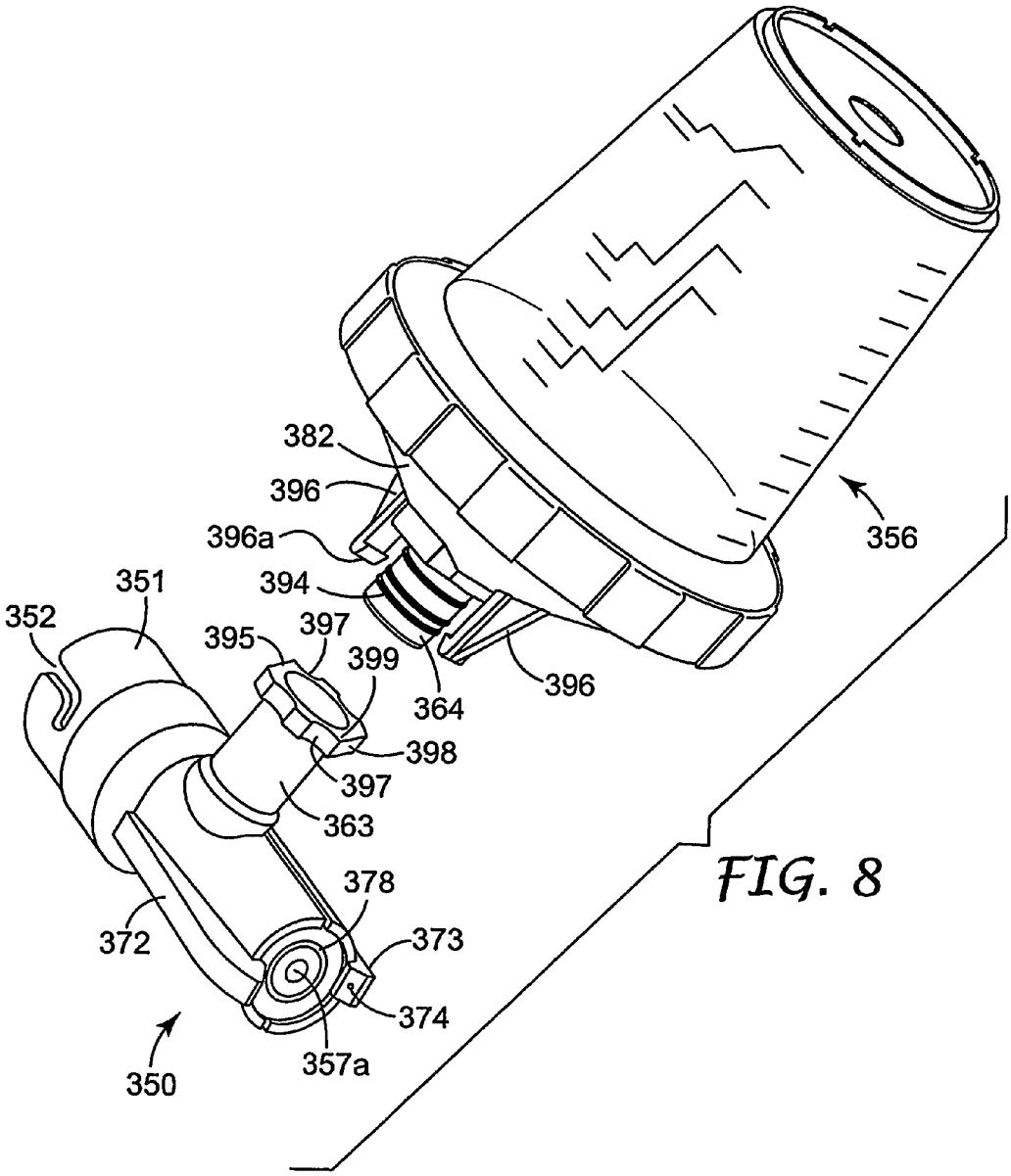
FIG. 8 is a perspective view showing an alternative connection between the spray head and reservoir shown in FIG. 7.

Referring now to FIG. 8, there is shown an alternative arrangement for releasably securing the reservoir to the spray head. For convenience, like reference numerals in the series 300 are used to indicate parts corresponding to the previous embodiments.

In FIG. 8, the lid 382 of the reservoir 356 has an outlet tube 364 that is a push fit in the inlet tube 363 of the spray head 350 and is sealed by annular ribs 394. The inlet tube 363 has an external flange 395 at the distal end and the lid 382 has a pair of hook members 396 engageable with the flange 395 to secure and retain the reservoir 356 on the spray head 350.

As shown the flange 395 has a pair of opposed recesses 397 leading to flats 398 via cam lobes 399. In use, the hook members 396 are aligned with the recesses 397 so as to pass the flange 395 when the reservoir 356 is pushed onto the spray head 350. The reservoir 356 is then rotated to cause the hook members 396 to engage the cam lobes 399 causing the hook members 396 to deflect outwards and snap back to engage the distal ends 396*a* behind the flats 398 to secure the reservoir 356 to the spray head 350.

In other respects, the construction and operation of the spray head 350 and reservoir 356 is similar to the previous embodiments and will be understood from the description of FIGS. 3 to 7.

Figure 9:
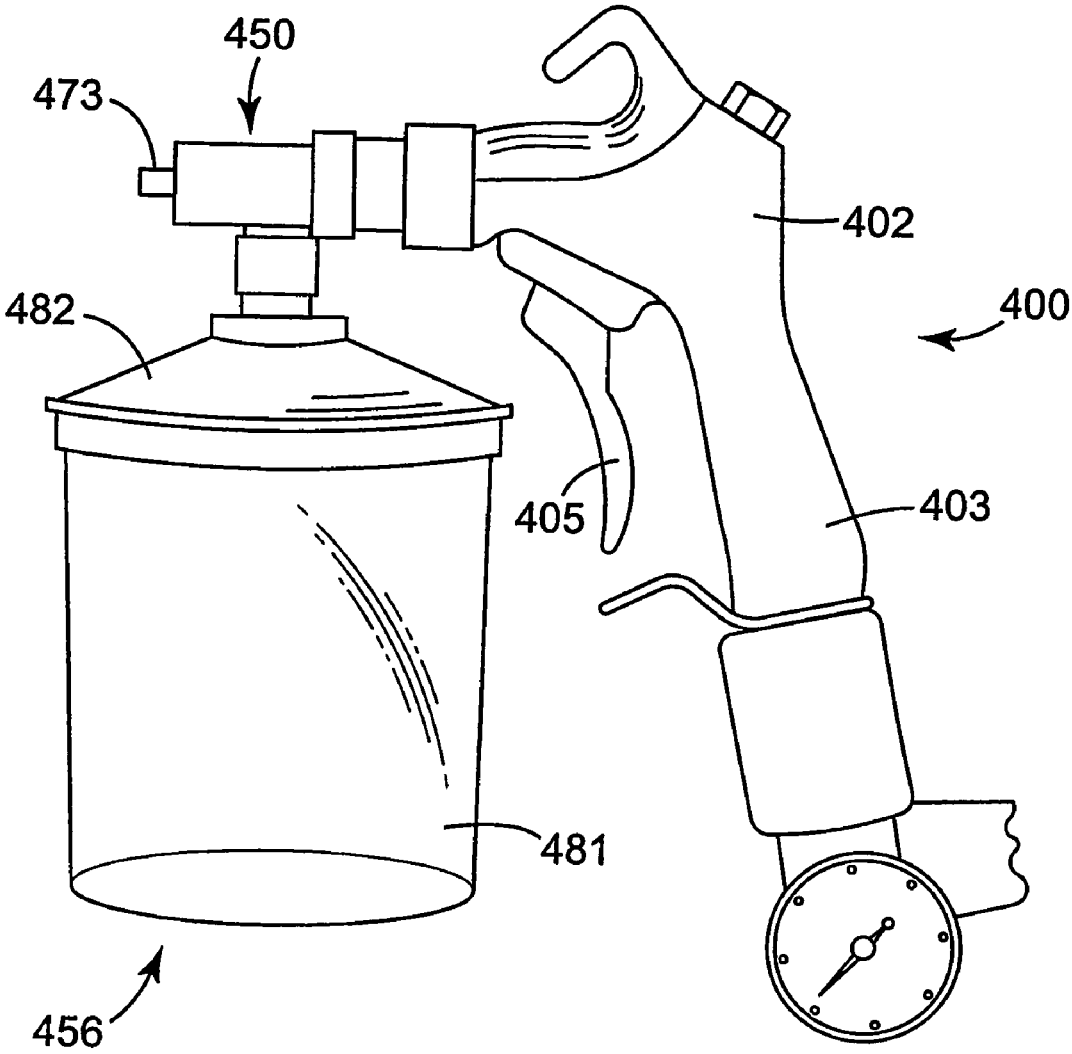
FIG. 9 is a side view of a suction feed spray gun embodying the present invention.

Referring now to FIG. 9, a suction feed spray gun according to a second embodiment of the present invention is shown in which like reference numerals in the series 400 are used to indicate parts corresponding to the first embodiment. The construction of the spray head 450 and reservoir 456 of this embodiment is generally similar to the first embodiment in which the paint contaminated spray head 450 and reservoir 456 are disposable and can be thrown away after use to reduce the amount of cleaning of the spray gun. The operation of this embodiment will be apparent to those skilled in the art familiar with suction feed spray guns without further description.

Figure 10:
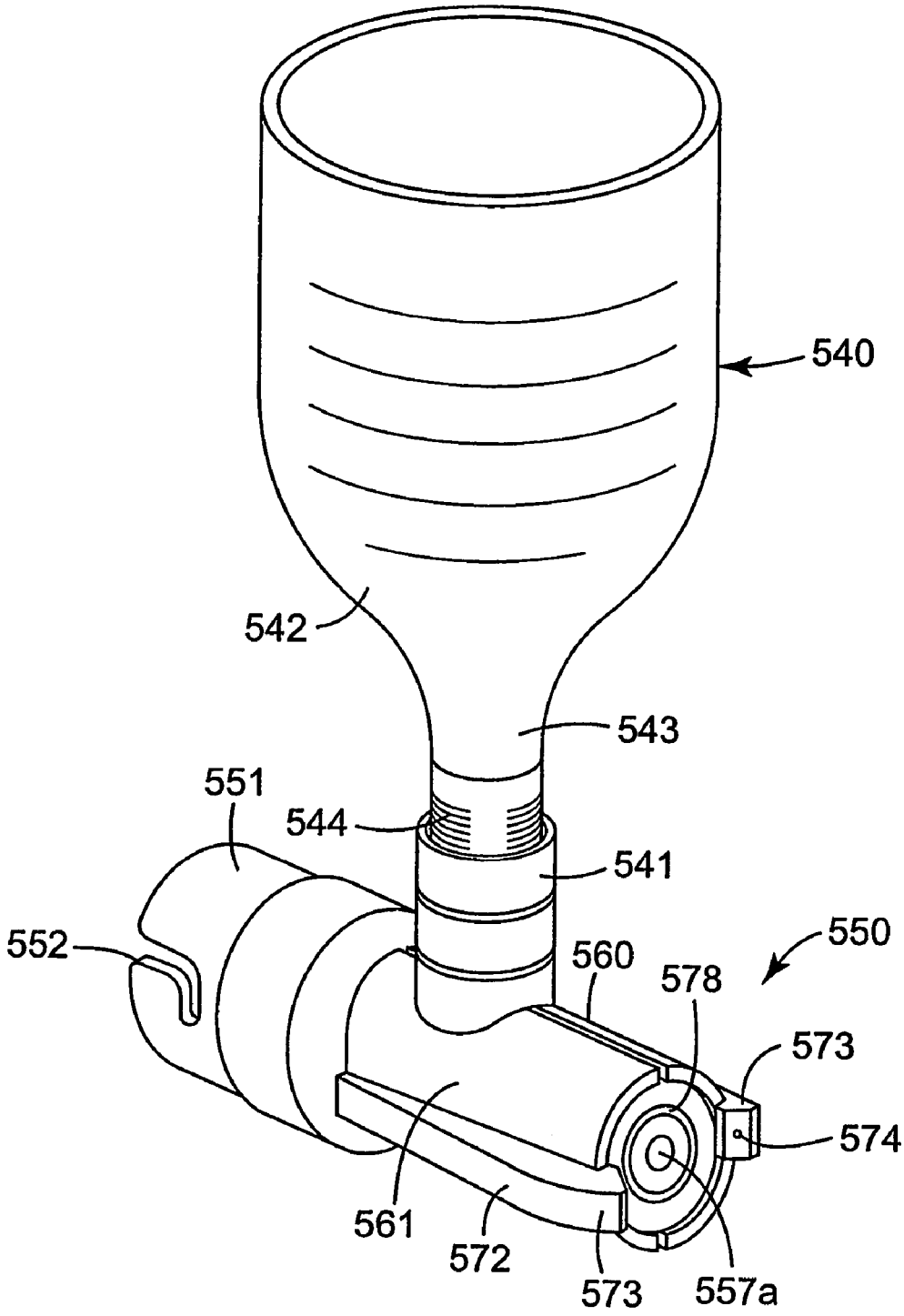
FIGS. 10 to 12 show alternative arrangements for supplying liquid to be sprayed to the spray head.
Figure 11:
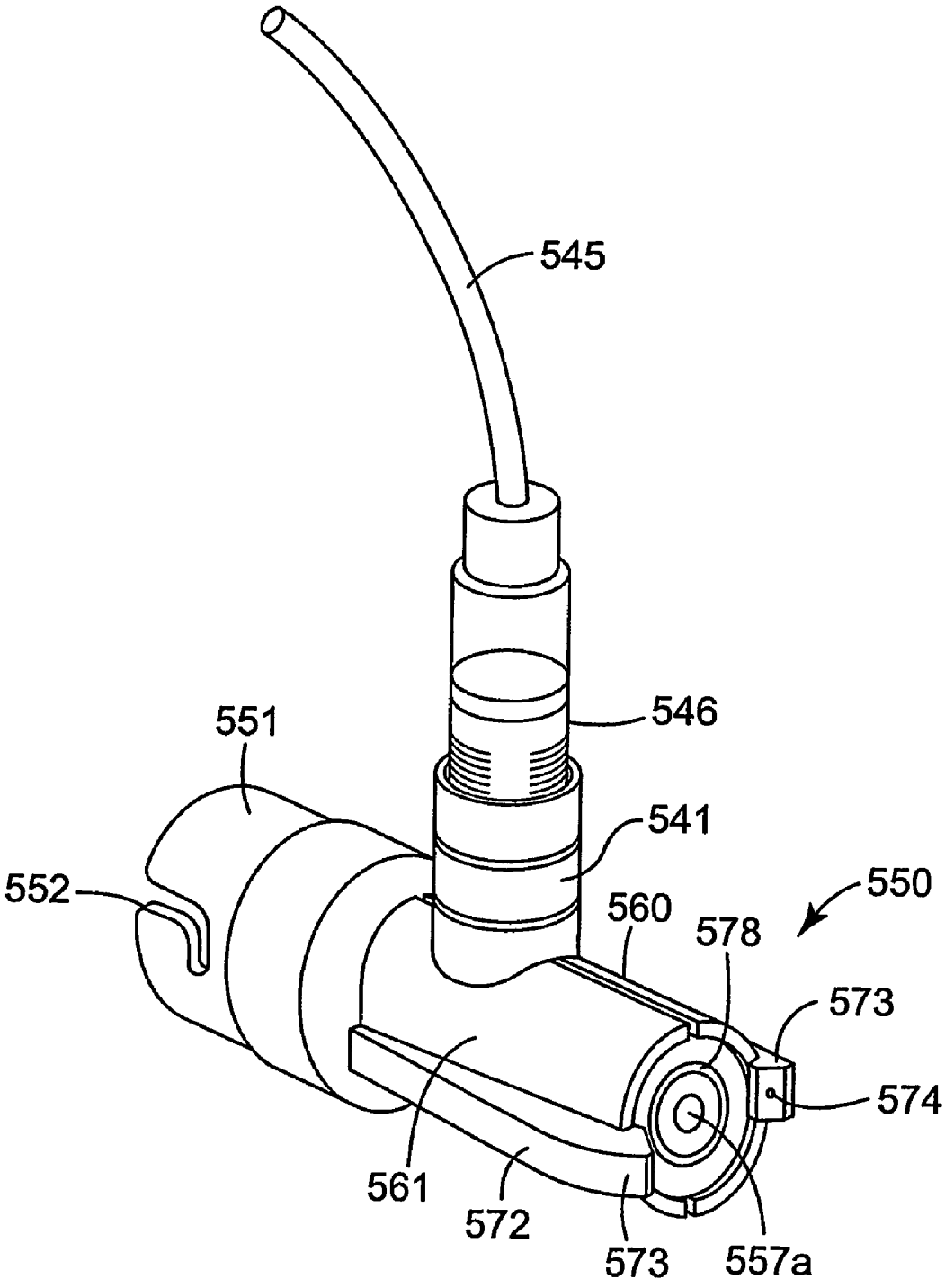
Figure 12:
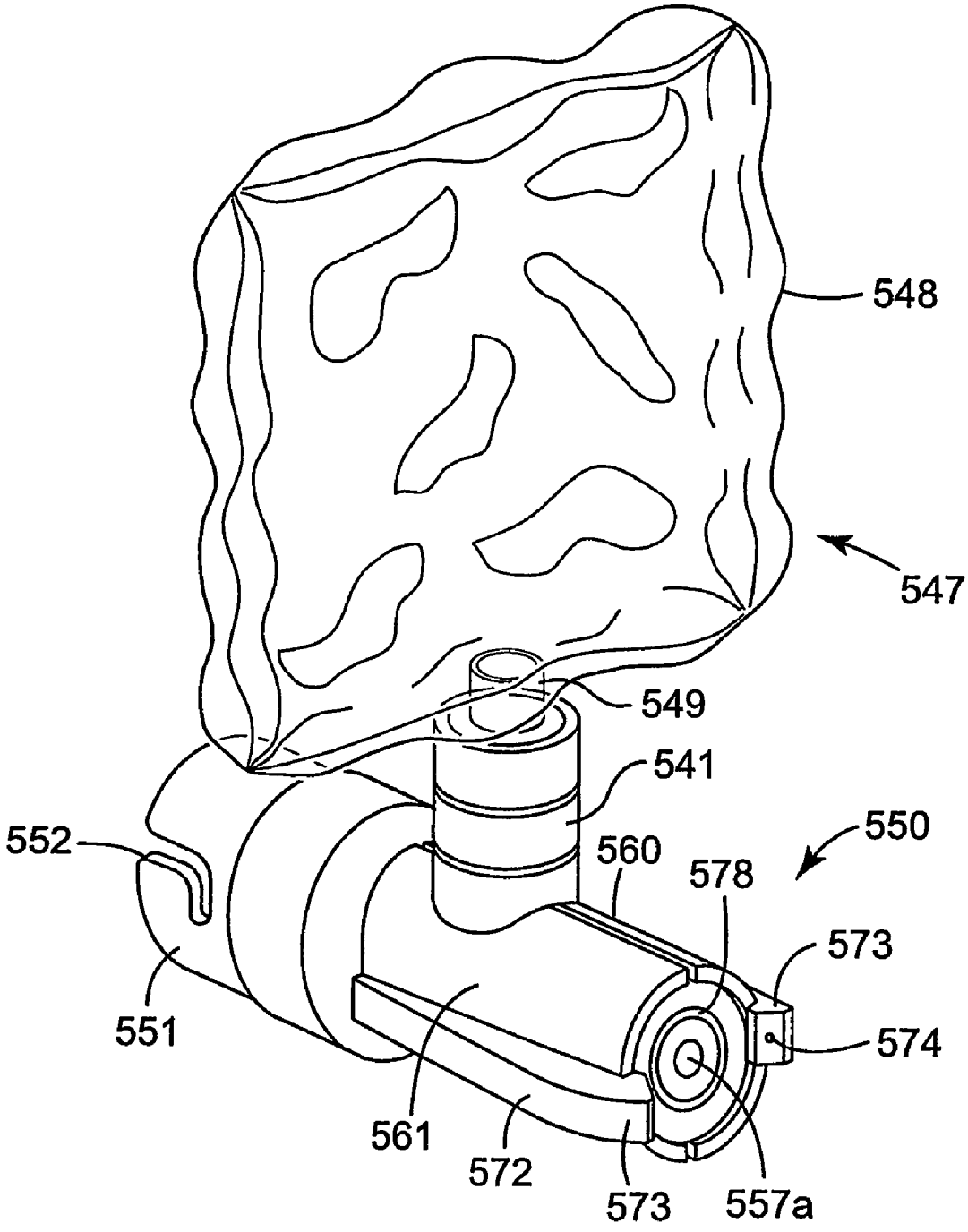

Referring now to FIGS. 10 to 12, various modifications of the paint delivery system of FIGS. 3 to 6 are shown employing different types of paint reservoir in combination with the disposable spray head. The spray head used in each of these modifications is similar to that described in the previous embodiments and for convenience like reference numerals in the series 500 are used to indicate corresponding parts in each of the Figures.

In FIG. 10, the spray head 550 is shown connected to a re-usable paint reservoir 540. The spray head 550 has an internally threaded inlet connector tube 541 and the reservoir 540 is a rigid pot 542 having an outlet tube 543 with an external screw thread 544 engageable with the internal screw thread of the inlet connector tube 541. After use, the spray head 550 is separated from the reservoir 540 and discarded, and the reservoir 540 is cleaned for re-use with another spray head. With this arrangement the overall amount of cleaning required may still be less than with some existing systems in which the paint or other liquid is delivered to the spray head through an internal passageway of the spray gun body that requires cleaning.

In FIG. 11, the spray head 550 is shown connected via a flexible line 545 to a remote paint reservoir (not shown). The line 545 has a connector 546 screwed into the inlet connector tube 541 of the spray head 550. Alternatively, a bayonet or tapered push-fit connection could be provided. After use, the line 545 can be detached from the spray head 550 which can be detached from the spray gun and thrown away. Again, the amount of cleaning of the spray gun is reduced and the line 545 can be connected to another spray head as desired. The remote reservoir may be a bulk storage container for a large volume of paint that can be used for several spraying operations and either thrown away after use or cleaned for re-filling with more paint.

In FIG. 12, the spray head 550 is shown connected to a collapsible paint reservoir 547 in the form of a pouch or bag 548. The bag 548 has a threaded connector 549 screwed into the inlet connector tube 541 of the spray head 550. The bag 548 may be pre-filled with paint and sealed by any suitable closure system until it is desired to attach the reservoir 542 to the spray head 550. In this way, the end user can purchase pre-packaged paint reservoirs 547 filled with paint for use with the spray head 550 and, after use, the paint contaminated spray head 550 and reservoir 547 can be discarded such that the amount of cleaning of the spray gun is reduced. This arrangement may be suitable for supply of paint that is stable under normal storage conditions until required for use. The reservoir may be made of any suitable material that is flexible and tear resistant, for example single or multiple sheets of metal foil or plastics.

As will now be appreciated, the present invention provides a paint delivery system for a spray gun that can reduce the amount of cleaning of the spray gun on completion of spraying or when changing over the spray gun to spray a different liquid. Thus, it will be appreciated that by connecting the reservoir to the spray head, the liquid is delivered to the spray nozzle through the spray head without passing through the spray gun body. In this way, contamination of the spray gun body by contact with the liquid being sprayed can be reduced so that cleaning of the spray gun is simplified and the amount of any solvents or other cleaning materials employed may be reduced, especially where both the spray head paint reservoir are disposable.

It will be appreciated that the exemplary embodiments described herein are intended to illustrate the diverse range and application of the invention and that features of the embodiments may be employed separately or in combination with any other features of the same or different embodiments.

Moreover, while the exemplary embodiments described and illustrated are believed to represent the best means currently known to the applicant, it will be understood that the invention is not limited thereto and that various modifications and improvements can be made within the spirit and scope of the invention as generally described herein.

Existing spray guns such as shown in FIGS. 1 and 2 may be converted for use with the spray head of the present invention. For example, the inlet in the spray gun body for connection to a paint reservoir could be closed, for example with a blanking plug, and an adaptor with bayonet lugs screwed onto the front end of the spray gun body for attaching the spray head.

Other modifications and changes apparent to those skilled in the art are deemed within the scope of the invention as defined in the following claims.

The invention claimed is:

1. A liquid spraying apparatus comprising a spray gun including:

a spray gun body provided with a trigger mechanism;

a spray head including a hollow body configured to releasably couple a rear end of the spray head to the spray gun body, and an insert having an axial bore and configured to axially insert into the hollow body, wherein the combination of the hollow body and the insert define a spray nozzle at a front end of the spray head;

a liquid reservoir coupleable to the hollow body and the axial bore of the insert for supplying liquid to the spray nozzle in response to actuation of the trigger mechanism such that liquid from the reservoir is delivered to the spray nozzle through the spray head without passing through the spray gun body, wherein the liquid reservoir is disposable and can be discarded after use; and air outlets arranged on opposite sides of the spray nozzle to provide air streams directed inwardly into liquid dispensed from the spray nozzle;

wherein an end of the hollow body and a front end of the spray gun body are provided with mateable formations that are engageable to secure the spray head to the spray gun body, the formations being releasable to detach the spray head from the spray gun body and a needle connected to the trigger mechanism, and the air outlets are provided on the spray head at the front end of the spray head body such that the air outlets and spray nozzle are connected to and disconnected from the spray gun body with the spray head.

2. Apparatus according to claim 1 wherein, the mateable formations form a bayonet type connection.

3. Apparatus according to claim 1 wherein, the spray head is connectable to a remote reservoir.

4. Apparatus according to claim 3 wherein, a flexible delivery line is provided between the reservoir and the spray head.

5. Apparatus according to claim 4 wherein, the delivery line includes a manually operable valve to close the delivery line when disconnected from the spray head.

6. Apparatus according to claim 1 wherein, the reservoir is mounted on the spray head.

7. Apparatus according to claim 6 wherein, a releasable connection is provided between the reservoir and the spray head such that the reservoir can be detached from the spray head.

8. Apparatus according to claim 7 wherein, the connection is a bayonet type connection.

9. Apparatus according to claim 1 wherein, the reservoir is re-usable.

10. Apparatus according to claim 1 wherein, the reservoir is collapsible as liquid is withdrawn in use.

11. Apparatus according to claim 1 wherein, the spray nozzle is adapted to atomise the liquid to form a spray.

12. Apparatus according to claim 11 wherein the spray nozzle provides a stream of compressed air concentric with the liquid emerging from the spray nozzle.

13. A liquid spraying apparatus comprising a spray gun including:

a spray gun body provided with a trigger mechanism;

a spray head body releasably connected at a rear end to the spray gun body and further including a spray nozzle at a front end, a liquid reservoir connected to the spray head body for supplying liquid to the spray nozzle in response to actuation of the trigger mechanism such that liquid from the reservoir is delivered to the spray nozzle through the spray head body without passing through the spray gun body, wherein the liquid reservoir is disposable and can be discarded after use; and air outlets arranged on opposite sides of the spray nozzle to provide air streams directed inwardly into liquid dispensed from the spray nozzle;

wherein the rear end of the spray head body and a front end of the spray gun body are provided with mateable formations that are engageable to secure the spray head body to the spray gun body, the formations being releasable to detach the spray head body from the spray gun body and a needle connected to the trigger mechanism, and the air outlets are provided on the spray head at the front end of the spray head body such that the air outlets and spray nozzle are connected to and disconnected from the spray gun body with the spray head body, the air outlets producing inwardly directed air streams are provided by a pair of horns projecting forwardly of an outlet for the liquid emerging from the spray nozzle and, the horns are detachable for adapting the spray nozzle for dispensing different liquids.

14. Apparatus according to claim 13 wherein, a set of interchangeable horns is provided for releasable connection to the spray head to change the atomisation parameters or spray pattern.

15. Apparatus according to claim 1 wherein, the needle of the trigger mechanism closes a bore through the spray head to prevent dispense of liquid from the spray nozzle and is retracted to open the bore when the trigger mechanism is actuated to allow dispense of liquid from the spray nozzle.

16. Apparatus according to claim 1 wherein, the spray gun is of the gravity feed, pressure feed or suction feed type.

17. Apparatus according to claim 1 wherein means is provided for adjusting one or more of the inwardly directed air streams to control the spray characteristics.

18. A spray head for use with a spray gun, the spray head comprising:

a hollow body and an insert configured to couple axially within the hollow body, the insert having a bore extending from a rear end of the insert to an outlet at a front end of the insert, the rear end of the hollow body having a formation to connect releasably the spray head to the spray gun, and the hollow body and the insert being connectable to a reservoir to supply liquid to the spray head, wherein the reservoir is disposable and can be discarded after use; and wherein the formation is engageable with a mating formation on the spray gun to secure the spray head to the spray gun with a needle connected to a trigger mechanism on the spray gun received in the bore to control dispense of liquid from the outlet, and the spray head having a pair of air holes disposed adjacent to the outlet and arranged on opposite sides of the outlet to provide air streams directed inwardly into liquid dispensed from the outlet.

* * * * *

UNITED STATES PATENT AND TRADEMARK OFFICE

CERTIFICATE OF CORRECTION

PATENT NO. : 7,484,676 B2
APPLICATION NO. : 10/529840
DATED : February 3, 2009
INVENTOR(S) : Stephen C. P. Joseph It is certified that error appears in the above-identified patent and that said Letters Patent is hereby corrected as shown below:

Column 3,
Line 45, delete "claim 19" and insert -- claim 18 --.

Column 8,
Line 4, delete "prayed" and insert -- sprayed --.

Column 10,
Line 43, after "couple" insert -- to --.

Signed and Sealed this

Ninth Day of June, 2009

JOHN DOLL
*Acting Director of the United States Patent and Trademark Office*